US007748665B2

(12) United States Patent
Janesky

(10) Patent No.: US 7,748,665 B2
(45) Date of Patent: Jul. 6, 2010

(54) CORD LIKE MANAGER AND CORD LIKE MANAGER KIT

(76) Inventor: Lawrence M. Janesky, 60 Silvermine Rd., Seymour, CT (US) 06483

( * ) Notice: Subject to any disclaimer, the term of this patent is extended or adjusted under 35 U.S.C. 154(b) by 463 days.

(21) Appl. No.: 11/360,194

(22) Filed: Feb. 23, 2006

(65) Prior Publication Data

US 2007/0196218 A1 Aug. 23, 2007

(51) Int. Cl.
*F16L 3/00* (2006.01)

(52) U.S. Cl. ..... 248/51; 248/67.7; 248/89; 242/388.9

(58) Field of Classification Search ..... 248/51, 248/52, 56, 67.5, 67.7, 68.1, 89, 90; 211/70.4; 242/400.1, 166, 388, 388.6, 388.9
See application file for complete search history.

(56) References Cited

U.S. PATENT DOCUMENTS 1,365,762 A * 1/1921 Zinow ..... 242/388.6
1,754,160 A * 4/1930 Colegrove ..... 242/400.1
2,354,404 A * 7/1944 Sayles ..... 248/72
3,312,434 A * 4/1967 Simon ..... 248/62
3,848,783 A * 11/1974 Falk ..... 224/448
4,067,526 A * 1/1978 Storer ..... 248/65
4,702,443 A * 10/1987 Callaway ..... 248/51
4,971,271 A * 11/1990 Sularz ..... 248/68.1
5,022,624 A * 6/1991 Hill ..... 248/274.1
5,137,156 A * 8/1992 Riczinger et al. ..... 211/13.1
5,303,887 A * 4/1994 Hasty et al. ..... 248/68.1
5,314,313 A 5/1994 Janesky ..... 417/63
5,334,186 A * 8/1994 Alexander ..... 604/180
5,361,756 A * 11/1994 Cernosek et al. ..... 600/301
5,730,396 A * 3/1998 Fovall ..... 248/51
5,992,788 A * 11/1999 Glass ..... 242/400.1
6,170,784 B1 * 1/2001 MacDonald et al. ..... 248/65
6,530,131 B1 * 3/2003 Hopkins ..... 24/300
6,962,306 B2 * 11/2005 West ..... 242/405.2
2002/0074460 A1 * 6/2002 Behar ..... 248/51
2002/0074462 A1 * 6/2002 Pontecorvo ..... 248/89
2003/0010862 A1 * 1/2003 Buyce et al. ..... 242/388.6
2005/0281679 A1 * 12/2005 Niedermeyer ..... 417/36

* cited by examiner

*Primary Examiner*—J. Allen Shriver, II
*Assistant Examiner*—Bradley H Duckworth
(74) *Attorney, Agent, or Firm*—Perman & Green, LLP

(57) ABSTRACT

A manager system for managing peripherals of a sump pump having a base and a manager frame. The base has a predetermined characteristic related a sump holding the sump pump. The manager frame is attached to the base at a predetermined ergonomic location with at least one fastener. The frame has a seat for resting the frame against the base and orienting the frame relative to the base. The frame has at least one fastener engagement surface engaged by the at least one fastener to stably hold the frame in the predetermined ergonomic location on the base. The frame has multiple storage locations adapted for storage of multiple sump pump peripherals on the frame.

13 Claims, 7 Drawing Sheets

CORD LIKE MANAGER AND CORD LIKE MANAGER KIT

BACKGROUND

1. Field

The disclosed embodiments relate to cord managers and, more particularly, to storage device for storing cord-like material such as an electrical extension cord and a kit for storing cord-like material and a record such as service record together.

2. Brief Description of Related Developments

Water control systems such as those that incorporate sump pumps, are used for admitting, channeling, collecting, and expelling ground water from basements and other subterranean rooms. The problems caused by the invasion of ground water are numerous and the use of such water control systems are widespread. Generally, water seeps into basements at various peripheral locations, especially between floor-wall joints, due to external hydrostatic pressures of water accumulations. These pressures can produce cracks in basement walls and floors. The admitted water is generally channeled by the water control system to a sump pump which is activated when the water level rises to an activation level to pump the water out of the basement through a conduit. The sump pump can be automatically activated when water reaches a predetermined level such a by activation of a float valve that detects the level of water in a sump. The sump pump can also be activated manually by an operator applying power to the pump when water accumulation has been observed. An example of a water control system is shown in U.S. Pat. No. 5,314,313, which is incorporated by reference herein in its entirety.

The sump pump and other power-driven equipment used with water control systems require a power cord. Generally, such power cords are supplied with these types of systems in relatively large lengths because the electrical power outlet can be close to the equipment or a relatively large distance from the equipment to which power is to be supplied. Also, depending on the design of the water control system, multiple power lines may be used along with extension power cord lines. With one or more fairly lengthy power cords, the management of these cords can be a problem. These cords tend to become bunched up and also can become entangled with sump pump devices such as float devices and the like. There is also the possibility that if the power cords are not carefully managed they can become immersed in water, such as in the sump well, which is undesired.

SUMMARY OF THE EXEMPLARY EMBODIMENT(S)

In one exemplary embodiment, the storage device has a frame including a first pair of receptacles for receiving cord-like material and a second pair of receptacles for receiving cord-like material whereby two sets of cord-like material can be kept separately supported on the frame, if desired.

In another embodiment the storage device includes a frame having ends and at least one pair of receptacle slots for receiving the cord-like material, at least one of said slots residing at an end of the frame.

In another embodiment, a record retainer includes a holder for a record and a fastener for coupling the record retainer to the storage device.

In another embodiment, a kit has a storage device including at least one pair of receptacles for receiving cord-like material; a record retainer including a holder for a record; and a fastener for coupling the record holder to the storage device.

In another embodiment, the storage device includes a frame having ends and a first pair of receptacle slots for receiving an electrical cord, at least one of said receptacle slots in the first pair residing at an end of the frame; and a second pair of receptacle slots for receiving cord-like material whereby the electrical cord and cord-like material can be kept separately supported on the frame, if desired.

In another embodiment, a kit for storing an electrical cord and record includes a frame with two ends and a first pair of slots for receiving the electrical cord, at least one of the slots in the first pair residing at an end of the frame, and a second pair of receptacle slots for receiving cord-like material whereby the electrical cord and cord-like material can be kept separately supported on the frame, if desired; a record retainer including a member for holding a record; and a fastener for releasably attaching the record retainer to the storage device.

In another embodiment, a kit for storing cord-like material includes a storage device having a frame with a first pair of receptacles for receiving cord-like material and a second pair of receptacles for receiving cord-like material whereby two sets of cord-like material can be kept separately supported on the frame, if desired, and a mounting system for coupling the storage device to an object.

BRIEF DESCRIPTION OF THE DRAWINGS

The foregoing aspects and other features of the present invention are explained in the following description, taken in connection with the accompanying drawings, wherein.

DETAILED DESCRIPTION OF THE EXEMPLARY EMBODIMENTS(S)

Figure 9A:
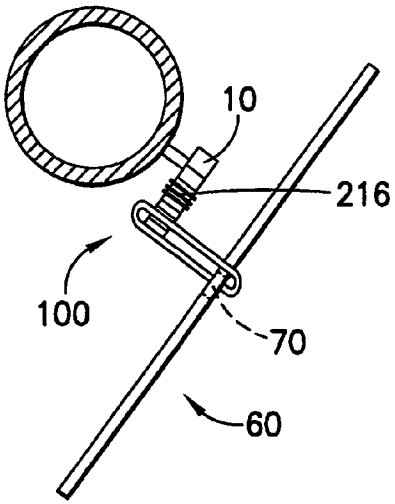
FIG. 9A is a top plan view of the manager system in FIG. 9.
Figure 9:
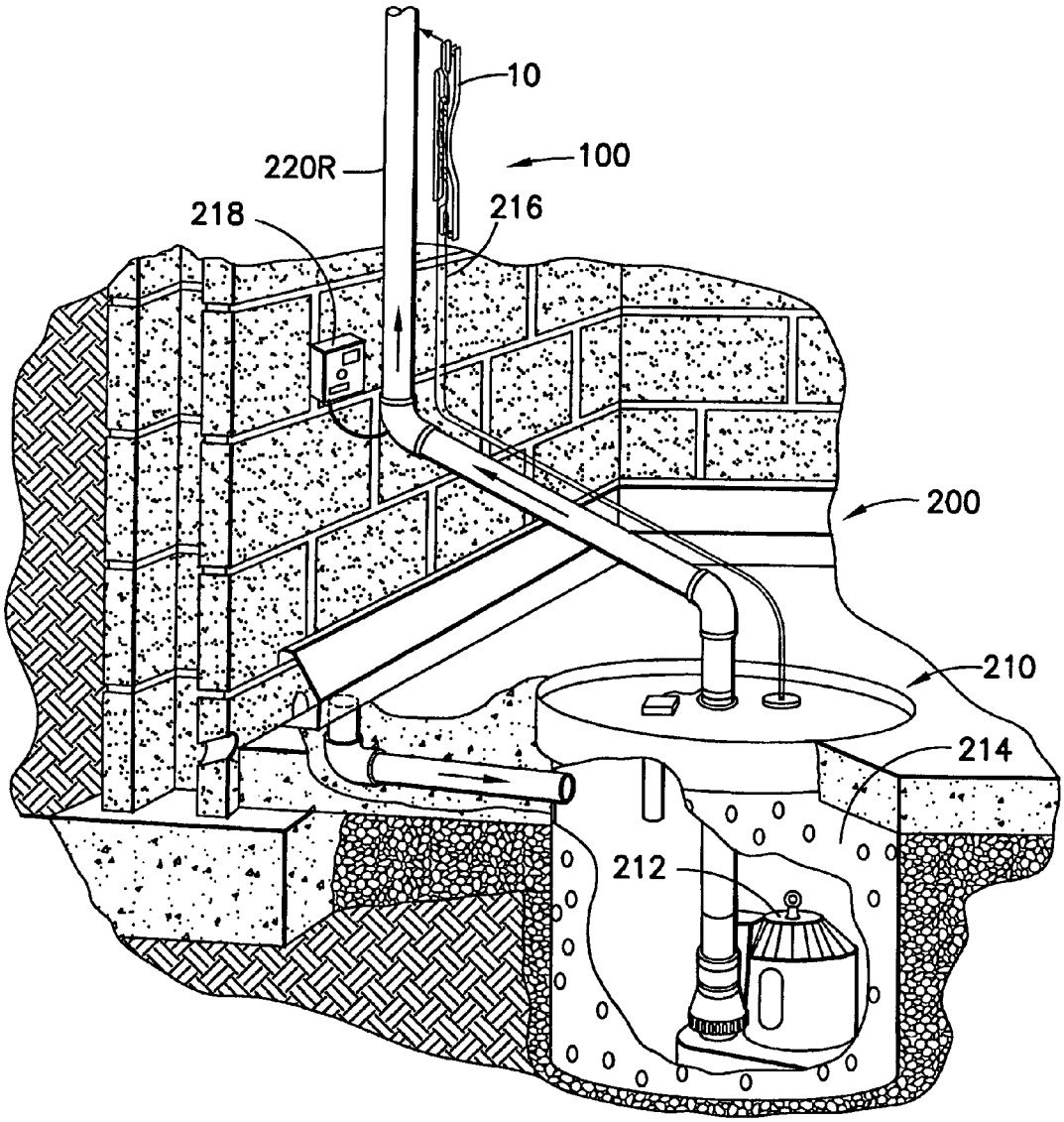
FIG. 9 is a schematic perspective view of a manager system incorporating features in accordance with an exemplary embodiment and a water control system of a basement with a sump and sump pumping system.

Referring to FIG. 9, there is shown a perspective view of a sump pump peripherals manager system 100 in accordance with an exemplary embodiment, and a water control system 200, of a basement or other at least partially subterranean chamber, that includes a sump 214 and sump pumping system 210.

As seen in FIG. 9, the water control system may generally have a water channeling system that collects water entering the basement and directs the collected water to the sump. The sump pumping system 210 in the exemplary embodiment may generally have a pump 212. In the exemplary embodiment, a representative pump is shown, though in alternate embodiments more than one pump may be located inside the sump (such as a primary pump and battery powered backup pump). The pump 212, which may be any suitable type of pump, such as a fluid-level actuated electrical pump, may be located in the sump 214. As may be realized, the sump pump 212 may have various peripherals 216 such as one or more cords for power and/or control signals or sensor signal. In the embodiment shown in FIG. 9, two cords are illustrated for example purposes. In alternate embodiments, there may be more or fewer cords. The pump 212, and indeed the sump pumping system 210 may have other peripherals, for example manuals, and other documentation for the pump, as well as a pump service log or record, and records for other portions of the pumping system such as a wall mounted alarm 218. In the exemplary embodiment, the pump 212 discharges through a conduit 220. The conduit 220 extends from sump to a discharge outlet (not shown). The shape of the conduit shown in FIG. 9 is merely exemplary, and in alternate embodiments, the conduit may have any desired shape. The discharge outlet may be located above ground, and in the exemplary embodiment the discharge conduit may have a portion 220R that rises from the elevation of the sump (e.g. somewhere near the floor of the basement) to the higher elevation of the discharge. As seen in FIG. 9, in the exemplary embodiment, the manager system 100 has a manager member or storage device 10 that has storage locations allowing management of the pump peripherals, such as the one or more cords and the records. The storage device 10 may be attached, for example by fasteners to the discharge conduit 220R at an ergonomically desired location. This provides easy access to an operator to store the pump peripherals onto the storage device 10, and access the peripherals from the storage device. A plan view of the storage device 10 attached to conduit 220R is shown in FIG. 9A. The manager system may also include one or more holders, for such items as the records or logs, that may be removably stored from the storage device 10. As may be realized, in this embodiment, the discharge conduit 220R defines a base or mounting platform for the storage device 10. In alternate embodiments, the storage device 10 may be mounted to any other desired basement structure that is generally proximate to the sump.

Figure 1:
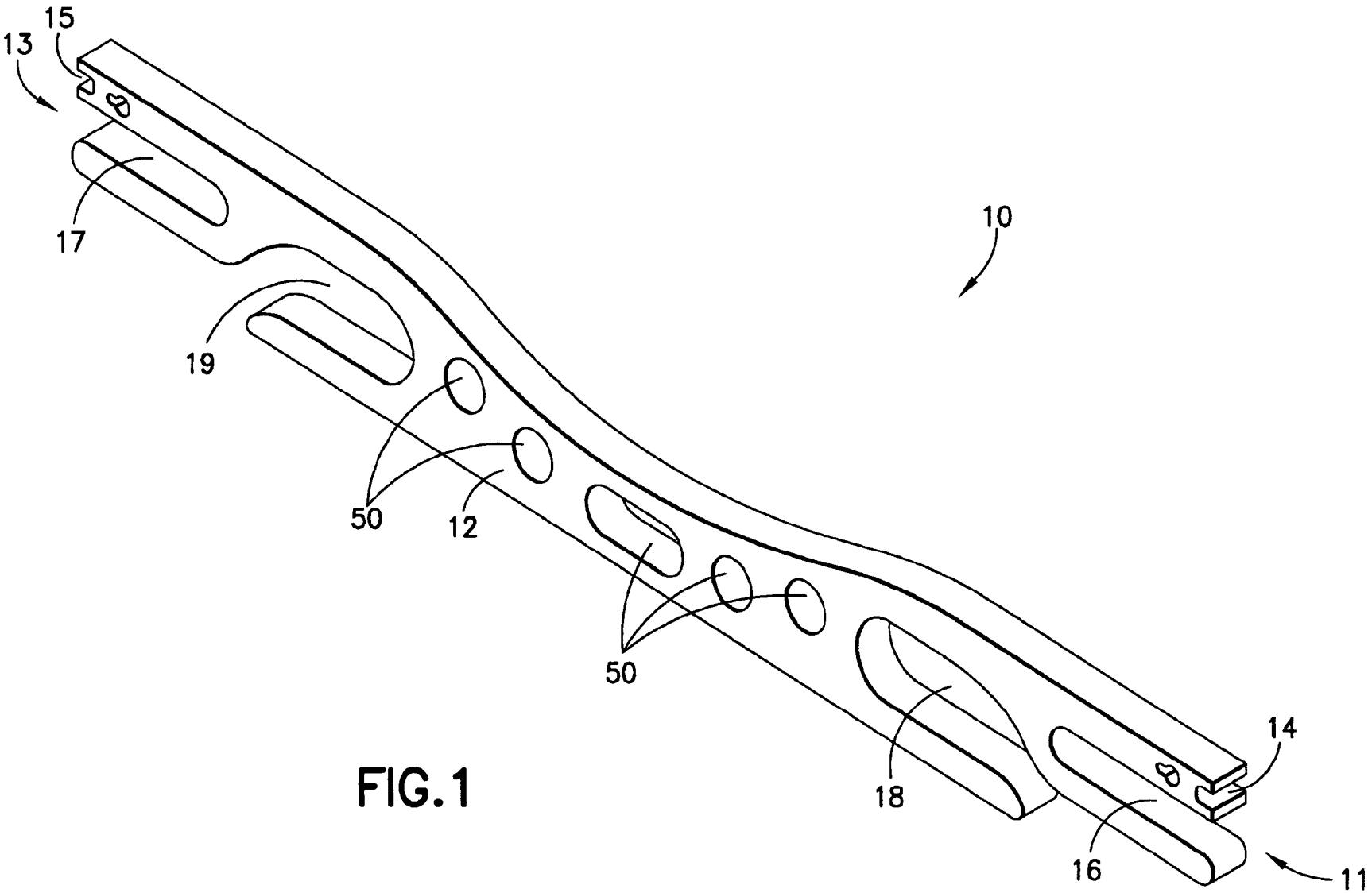
FIG. 1 is a perspective view of the storage device for cord-like material.
Figure 2:
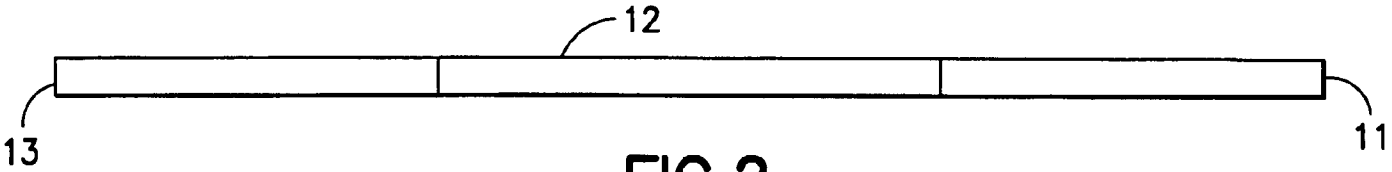
FIG. 2 is top view of the device shown in FIG. 1.
Figure 3:
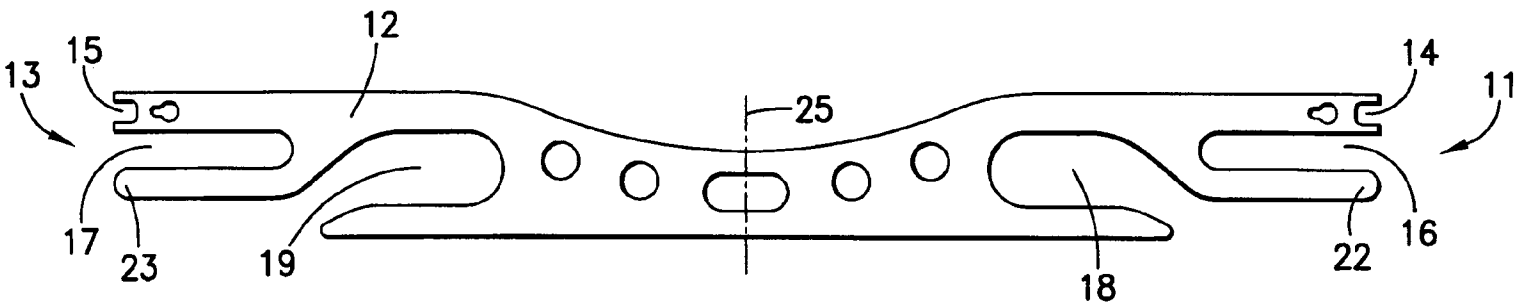
FIG. 3 is front view of the device shown in FIG. 1.
Figure 4:
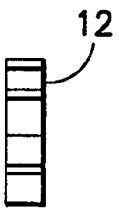
FIG. 4 is a side view of the device shown in FIG. 1.

FIG. 1 illustrates an exemplary embodiment of the storage device. As noted above, storage device 10 may be used to manage/store cord-like material. The cord-like material can be of any suitable type. For example, the cord-like material can be an electrical power cord, an electrical extension cord, wire, rope, string, tape, rubber material, yarn, fiber material, filament material, thread, line, cable, braid, twine, etc. The terms cord and cord-like material as used herein are intended to be viewed in their most broad meaning and include any relatively slender, somewhat flexible material.

Storage device 10, as shown in FIGS. 1 to 4, includes frame 12 with frame ends 11 and 13. The frame can be made of any suitable material. For example, the frame can be made of structural foam material, plastic, metal, wood, etc. The frame 12 may be of unitary construction. The frame, as shown in the embodiment of FIGS. 1 to 4, is relatively long and thin, however, any suitable shape may be used that serves the intended function. Frame 12 may have mounting apertures 50, such as holes or slots for mounting the storage system to an object. Frame 12 has at least one pair of receptacles for receiving cord-like material. In the embodiment shown in FIGS. 1 to 4, frame 12 has three pairs of receptacles: slot pair 14 and 15, slot pair 16 and 17 and slot pair 18 and 19. Any desired number of slot pairs can reside on the frame.

The slot pairs enable the frame to manage and store one or more lengths of cord-like material. For example, if desired, slot pair 14 and 15 can be used to wrap relatively small diameter cord-like material onto the frame so that the material is maintained in a controlled manner. Likewise, slot pair 16 and 17 and slot pair 18 and 19 can be used to wrap larger diameter cord-like material onto the frame. The different slot pairs may also be used to keep separate different types cord-like material, depending on the intended use of the storage device. For example, the excess length of a working power cord may be mounted onto the frame in one slot pair, an extension cord may be wrapped around another slot pair, a length of rope wrapped around still another slot pair, etc. to facilitate the management and separation of the different materials. Furthermore, if the frame has several slot pairs, more than one of the slot pairs may be used to wrap different portions of the same cord-like material on the frame.

Figure 7:
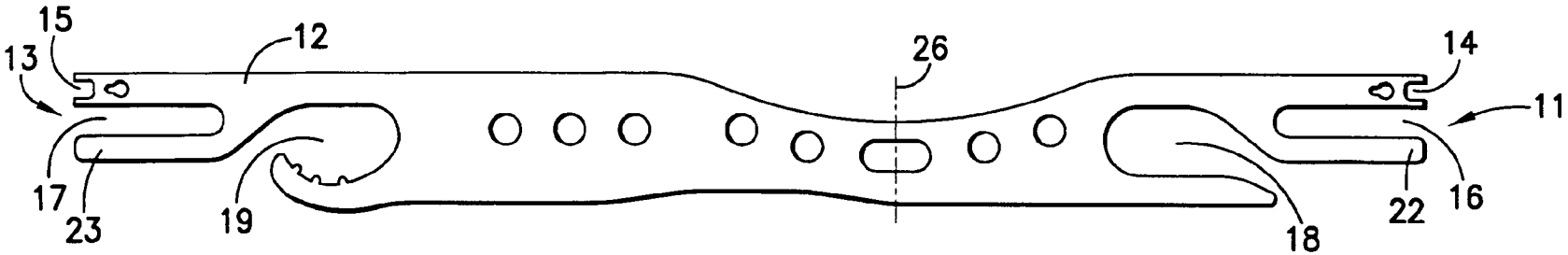
FIG. 7 is an illustration of another embodiment of the storage device.

The slots may have entrance portions shaped in such a way that the slots readily receive the cord-like material. As may be seen best in FIG. 3, slots 16 and 17 have entrance portions 22 and 23, respectively, which are shaped to easily receive the cord-like material. The distance that the receptacles or slots of each receptacle pair are set apart may vary. Also, the depth, width and shape of the individual slots may vary. For example, in the embodiment of frame 12 shown in FIGS. 1 to 4, slot pair 14, 15 are placed at the ends of the frame while the slots of slot pairs 16, 17 and 18,19 are separated by different distances as compared to slots 14 and 15. In the embodiment of frame 12 shown in FIGS. 1 to 4, the slot pairs are roughly centered around the centerline of the frame. However, the slot pairs may take any suitable location on the frame and need not be placed in such a manner. For example, as shown in FIG. 7, each slot pair can be randomly placed on the frame relative to reference line 26. In addition, the shapes of the receptacles or slots in each pair do not have to be mirror images of each other as further shown in FIG. 7. Although frame 12 is shown in FIGS. 1 to 4 as a somewhat elongated element, the frame can take any shape desired such as angled, arcuate, L-shaped, etc. Furthermore, although the end shape and cross-section shape of frame 12 is shown as generally rectangular in FIG. 4, it may take any suitable shape such as square, round, oval, compound, complex, etc.

Figure 8:
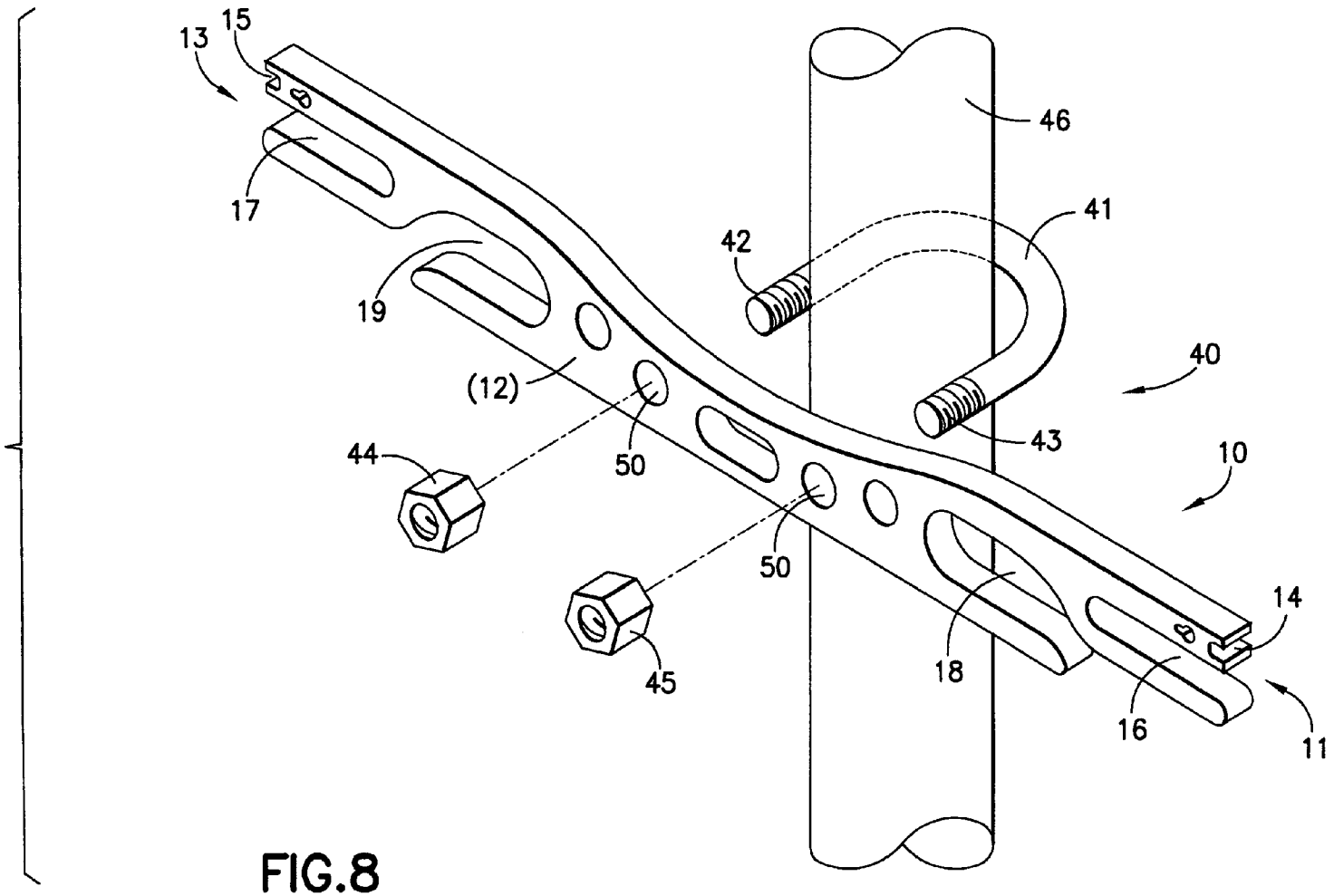
FIG. 8 is an exploded perspective view of the storage device and a mounting system.

Storage device 10 may be provided to the site in the form of a kit to further enhance the management of water control systems, sump pumps and cord-like material. An embodiment of such a kit is shown in FIG. 8. This embodiment includes storage device 10 and a mounting system 40. A convenient location to mount the storage system for optimal management of the cord-like material, such as a power cord for a sump pump, is often in the vicinity of the sump pump. Sump pump systems normally have a conduit or pipe to carry the water being pumped out of the basement such as conduit 46 shown in broken lines in FIG. 8. In this embodiment, the mounting system for frame 12 is a pipe clamp 41 having threaded ends, 42 and 43, and nuts 44 and 45. This kit, which includes the frame 12 and mounting system 40, can be used to mount the frame to the conduit or other object. The pipe clamp is place around the conduit and the frame is placed against the conduit with the threaded ends of the pipe clamp passing through holes 50 in the frame. Nuts 44 and 45 are then threaded onto the protruding threaded ends of the pipe clamp and tightened to hold the frame on the conduit. Other embodiments of the mounting system may be used depending upon the place where the frame is to be mounted. For example, if the frame were to be mounted to a stud or rafter, the mounting system may consist of one or more wood or metal screws. The frame is placed against one or more studs or rafters and one or more screws are placed through apertures 50 and screwed into the studs or rafters. Any suitable mounting device may be used to secure the frame in a desired location.

Figure 5:
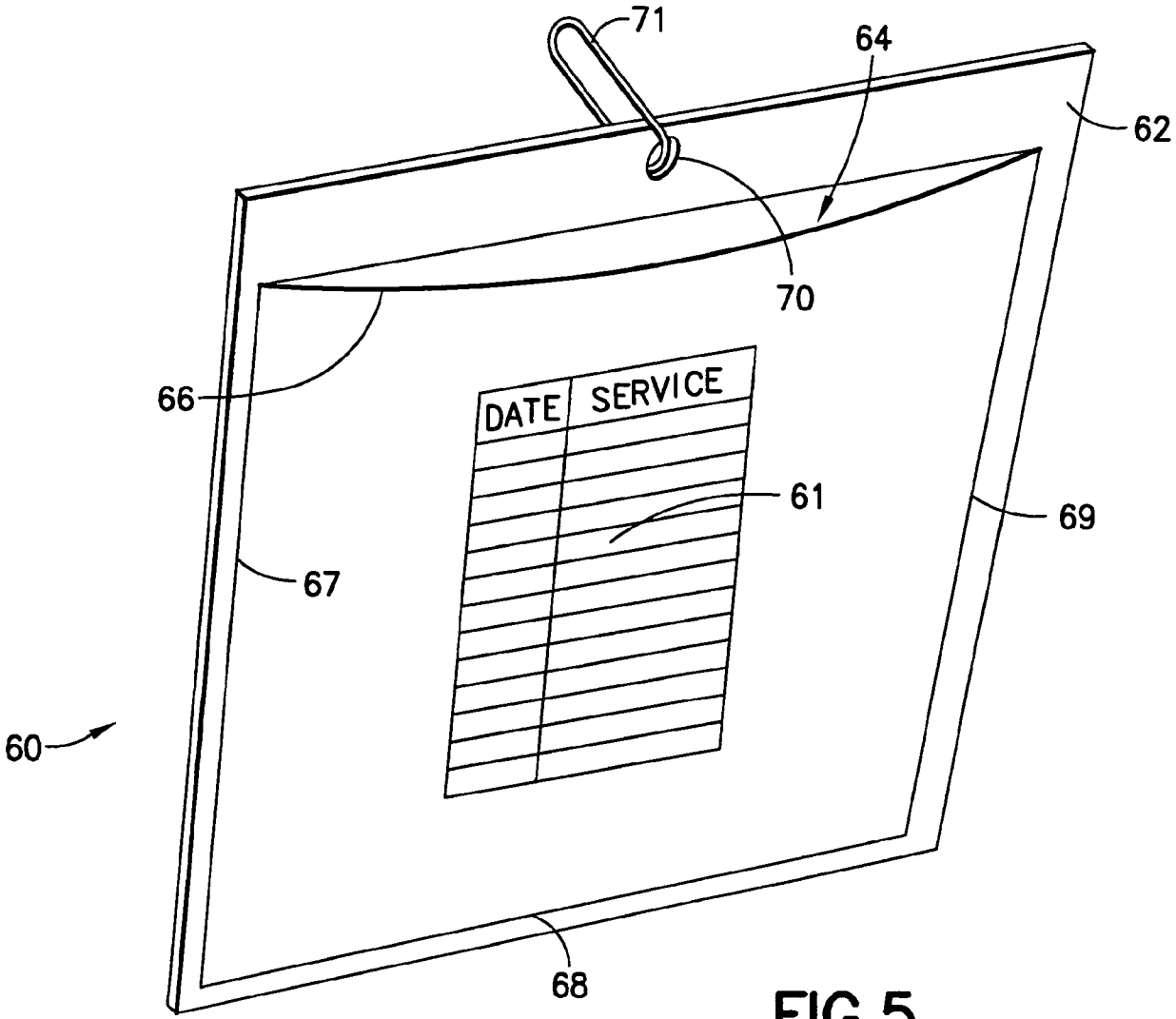
FIG. 5 is an perspective view of a record holder.
Figure 6:
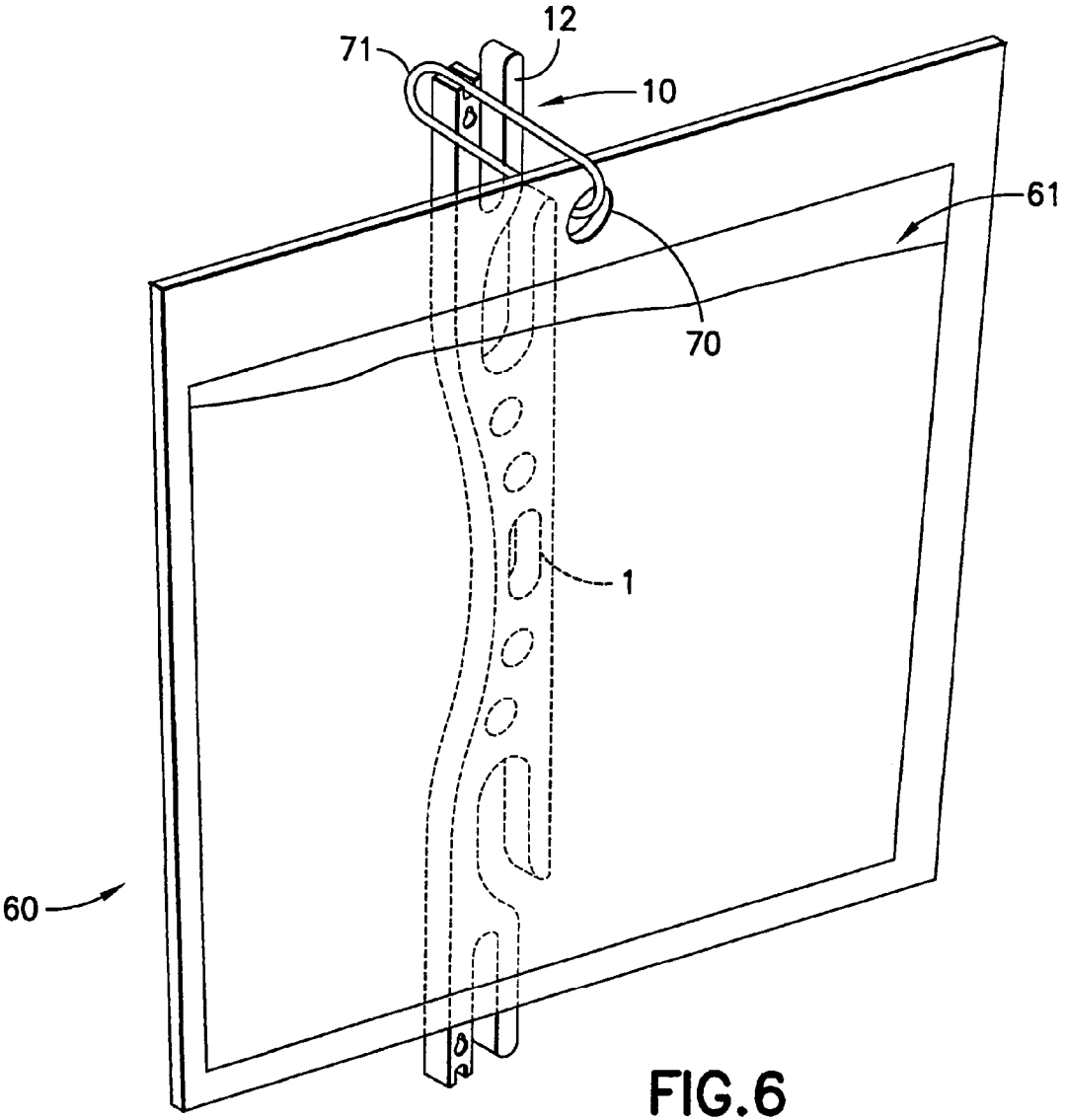
FIG. 6 is a perspective view of an assembled kit including the storage device shown in FIG. 1, the record holder shown in FIG. 5 and a fastener securing the two together.

Another embodiment of a kit including storage device 10 provides a record holder or retainer and a fastening system to couple the record holder to the storage device. The elements included in such a kit are illustrated in FIGS. 5 and 6. FIG. 5 illustrates an embodiment of record retainer 60. Record retainer 60 may hold any suitable type of record 61 and the record can be in any suitable medium. For example, the record may be a historical record of the water control systems operation, log, service manual, operator's manual, etc. The record may be in the form of a sheet(s) of paper, calendar, diary, journal, register, notebook, computer, compact or floppy disk, terminal, connection, telephone, cell phone, jack, etc. In the embodiment shown in FIG. 5, the record retainer has a board 62, such as a stiff, durable cardboard or plastic material, with a pocket front 66 attached to the board along three edges, 67, 68 and 69. The top of the pocket front is left unattached to the board so that a pocket with a top opening is formed between the board and pocket front. Record 61 can be placed in and retrieved from the record retainer through the top opening. The record retainer also may have a fastener for fastening it to the storage system. In the embodiment shown in FIG. 5, a hole 70 is placed in the top of the record retainer board and a looped wire 71 is located in the hole. In this embodiment, the record retainer 60 is coupled to storage device 10 by setting the looped wire onto the end of the storage device 10, as shown in FIG. 6, so that the record retainer and storage device are coupled together. Any suitable embodiment of the fastener may be employed to couple the record retainer to the storage device. For example, a twist-tie may use by threading the twist-tie through hole 70 and twist-tying it to the storage device, either at the end 11 of frame 12 or through one of the holes 50 in frame 12. FIG. 6 shows the storage device 10 and record retainer 60 coupled together and cord-like material 1 shown (in broken lines) wrapped on the storage device.

In another embodiment of the kit, the kit may include storage device 10, mounting system 40 and record holder 60. In all such kits, the individual components of the kits may be supplied in a single package, such as a blister pack, for easy marketing and installation. The installer may choose the kit desired and then open it for installation onto the water control system.

It should be understood that the description is only illustrative of exemplary embodiments incorporating features of the invention. Various alternatives and modifications can be devised by those skilled in the art without departing from the invention. Accordingly, the present invention is intended to embrace all such alternatives, modifications and variances that fall within the scope of the appended claims.

What is claimed is:

1. A sump pump peripherals manager system for managing peripherals of a sump pump, the system comprising:

a base defining a discharge conduit of a sump holding the sump pump;

a manager frame attached to and supported by the discharge conduit at a predetermined ergonomic location with at least one fastener, the frame having a seat, for resting the frame against the base and orienting the frame relative to the base, and having at least one fastener engagement surface engaged by the at least one fastener and disposed so that the at least one fastener cooperates with the seat to clamp the discharge conduit and fixedly hold the frame in the predetermined ergonomic location on the base;

wherein the frame has multiple storage locations adapted for storage of multiple sump pump peripherals on the frame.

2. The system of claim 1, wherein the predetermined characteristic is that the base is structure proximate the sump.

3. The system of claim 1, wherein the predetermined characteristic is that the base is a discharge conduit of the sump pump extending from the sump to the predetermined ergonomic location.

4. The system of claim 1, wherein the at least one fastener is selected from at least one of a hose clamp, wire tie, or plastic tie.

5. The system of claim 1, wherein the multiple storage locations comprise separate storage locations for separate cords.

6. The system of claim 1, wherein the multiple storage locations comprise at least one storage location for a cord and at least another storage location for a manual or record holder.

7. The system of claim 1, further comprising a record retainer removably connected to the frame, the record retainer comprising a holder and another fastener for removably attaching the holder to the frame.

8. The system of claim 7, wherein the other fastener is engaged to the frame in one of the multiple storage locations.

9. The system of claim 1, wherein the frame has at least one pair of receptacle slots, at opposite ends of the frame, for receiving a cord therein, the at least one pair of receptacle slots forming at least one of the multiple storage locations.

10. A kit for storing sump pump peripherals comprising a storage frame having at least one pair of receptacles formed therein for receiving cord material, the frame having a seat; a record retainer including a holder for a record; a fastener for removably coupling the record retainer to the storage frame; and a base defining a discharge conduit of a sump holding the sump pump; the storage frame attached to and supported by the discharge conduit at a predetermined ergonomic location with at least one fastener and disposed so that the at least one fastener cooperates with the seat to clamp the discharge conduit and fixedly hold the frame in the predetermined ergonomic location on the base.

11. The kit of claim 10 wherein the frame is of unitary construction and the kit further comprises at least one fastener adapted for fastening and stably holding the frame onto a sump pump conduit.

12. The kit of claim 11 wherein the at least one fastener is at least one of a hose clamp, wire tie, or plastic tie.

13. The kit of claim 11, wherein the frame has multiple fastener holes formed therein and distributed along the frame, and wherein the at least one fastener is selectably engageable to at least one of the multiple fastener holes in accordance with at least one of a configuration of the conduit or orientation of the frame.

* * * * *